United States Patent [19]

Nicholl et al.

[11] 3,944,761

[45] Mar. 16, 1976

[54] ROTARY SWITCH

[75] Inventors: Thomas H. Nicholl, Leawood, Kans.; John J. Collins, Kansas City, Mo.

[73] Assignee: Nicholl Brothers, Inc., Kansas City, Mo.

[22] Filed: Nov. 29, 1974

[21] Appl. No.: 528,284

[52] U.S. Cl. ..... 200/11 EA; 200/60; 200/291

[51] Int. Cl.[2] ..... H01H 21/50; F21V 23/04

[58] Field of Search ..... 200/11 C, 11 E, 11 EA, 200/62–66, 60, 291

[56] References Cited

UNITED STATES PATENTS

| | | | |
|---|---|---|---|
| 3,005,882 | 10/1961 | White | 200/11 EA |
| 3,244,820 | 4/1966 | Cannon | 200/11 E |
| 3,596,013 | 7/1971 | Pihl | 200/11 EA |

*Primary Examiner*—James R. Scott

*Attorney, Agent, or Firm*—Fishburn, Gold & Litman

[57] ABSTRACT

A finger-actuated rotary switch adapted for use in electric devices, such as lanterns, and operative to select a desired light or light combination wherein the rotary switch is a waterproof structure and includes an elongated rotatable stem extending through a stator and having a switch rotor retained on one end thereof. The switch rotor is in engagement with the stator and relative movement between the switch rotor and the stator is effective to move the switch rotor into and out of engagement with electrical contact heads extending from the stator all in response to movement of cam followers which extend from the switch rotor and move along and in engagement with a cam surface on the stator. The switch rotor is resiliently maintained in engagement with the stator. A support is positioned between the stator and an operating knob on the stem.

11 Claims, 11 Drawing Figures

Fig. 3.
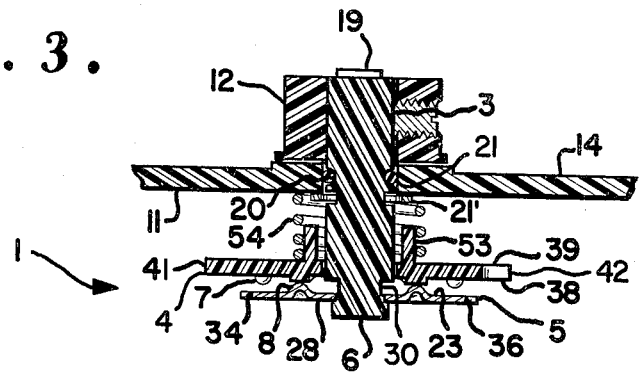
Fig. 10.
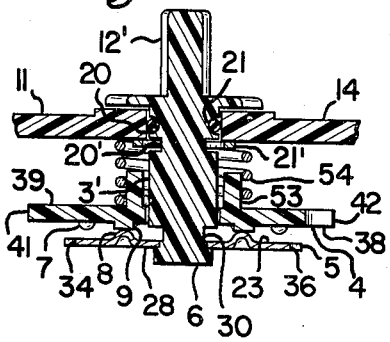
Fig. 11.
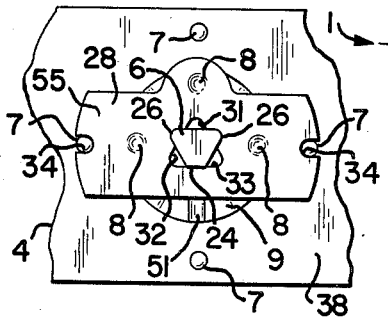
Fig. 9.
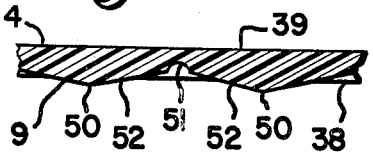
Fig 4.
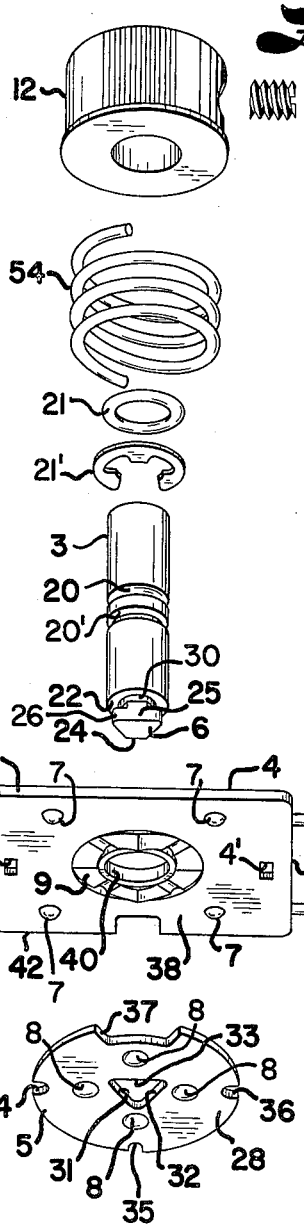
Fig. 5.
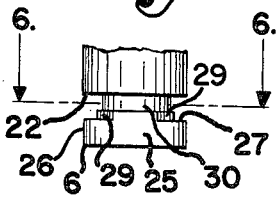
Fig. 6.
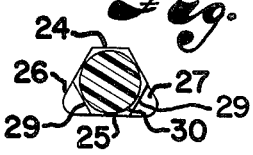
Fig. 7.
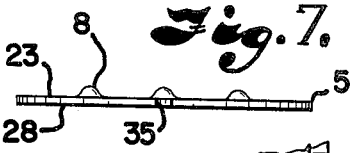
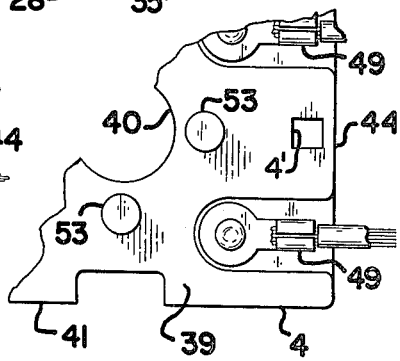
Fig. 8.

ROTARY SWITCH

The present invention relates to an improved electrical switching device and more particularly to a finger-actuated rotary switch which may be easily manipulated by the user to select one of a plurality of alternative positions.

The principal objects of the present invention are: to provide a finger-actuated rotary switch adapted for use in an electric device, such as a lantern, and operative to select a desired light or light combination; to provide such a rotary switch having positive movement of a switch rotor into and out of engagement with electrical contacts which are respectively electrically connected to any desired circuit; to provide such a rotary switch which can be waterproofed for use in a waterproof electric lantern; to provide such a rotary switch which may be readily assembled on a support therefor and fixed in position solely by interaction of the switch components with the support; to provide such a switch having a rotatable stem and a switch rotor or plate thereon and multiple positions with at least three lift points cooperating with two or more pressure points on the stem radially spaced from the axis, inwardly of said lift points and forming a polygon or triangle having said axis therein to maintain said rotor substantially normal to said axis; to provide such a rotary switch adapted for enclosure within a cover for use in high voltage systems; to provide such a rotary switch wherein the respective components of the switch form an integrated operational assembly; and to provide such a rotary switch which is economical to manufacture, durable in construction, positive positioning in operation, versatile in use, formed of a minimum of parts, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include an exemplary embodiment of the present invention and illustrate various objects and features of the rotary switch.

FIG. 3 is an enlarged longitudinal sectional view taken on line 3—3, FIG. 2.

FIG. 4 is an enlarged exploded perspective view showing the components of the rotary switch.

FIG. 5 is a further enlarged fragmentary side elevational view of a stem of the rotary switch.

FIG. 6 is also a further enlarged transverse sectional view of the stem and taken on line 6—6, FIG. 5.

FIG. 7 is also a further enlarged side elevational view of a switch rotor of the rotary switch.

FIG. 8 is also a further enlarged fragmentary plan view of a stator of the rotary switch as taken on line 8—8, FIG. 3.

FIG. 9 is also a further enlarged developed sectional view of cam surfaces on the stator.

FIG. 10 is an enlarged longitudinal sectional view of a modified rotary switch.

FIG. 11 is diagrammatic view of a switch plate with three lift points with multiple contacts.

Figure 1:
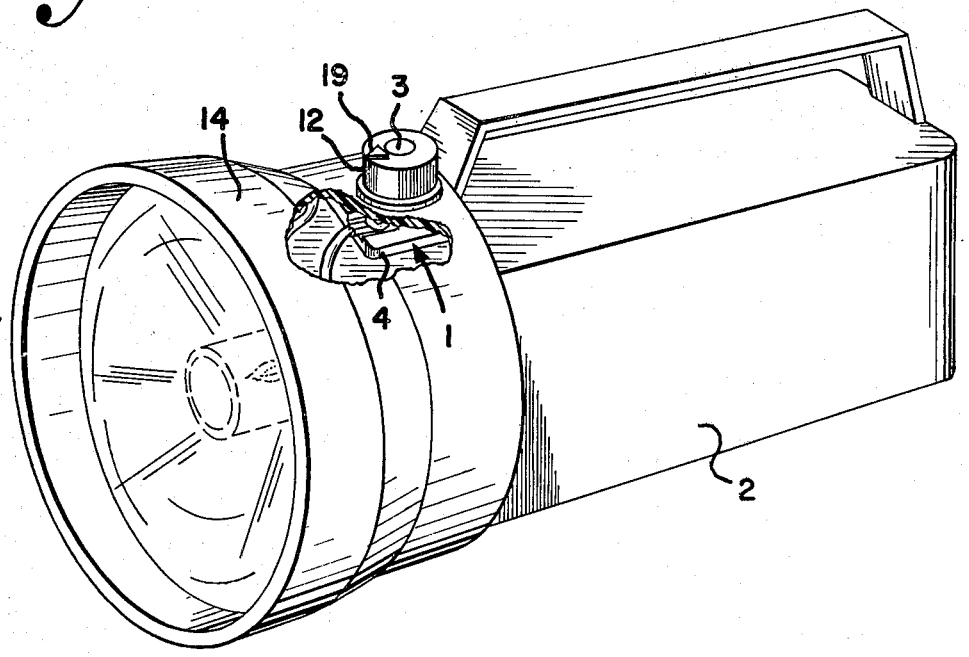
FIG. 1 is a perspective view of a rotary switch embodying features of the present invention and shown mounted on a lantern housing with portions broken away.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

In the disclosed embodiment of the present invention, the reference numeral 1 generally designates a finger-actuated rotary switch adapted for use in an electric device, such as a lantern 2, and operative to select a desired light or combination of lights. The rotary switch 1 includes an elongated rotatable stem 3 extending through a stator 4 and having a switch rotor 5 retained on one end 6 of the stem 3. The switch rotor 5 is in engagement with the stator 4 and relative movement between the switch rotor 5 and the stator 4 is effective to move the switch rotor 5 into and out of engagement with electric contact heads 7 which extend from the stator 4 all in response to movement of cam followers 8 which extend up from one of the stator and the switch rotor 5 and move along and in engagement with a cam surface 9 on the other of the stator 4 and rotor 5. The switch rotor 5 is resiliently maintained in engagement with the stator 4. A support 11 is positioned between the stator 4 and an operating knob 12 on the stem 3.

Figure 2:
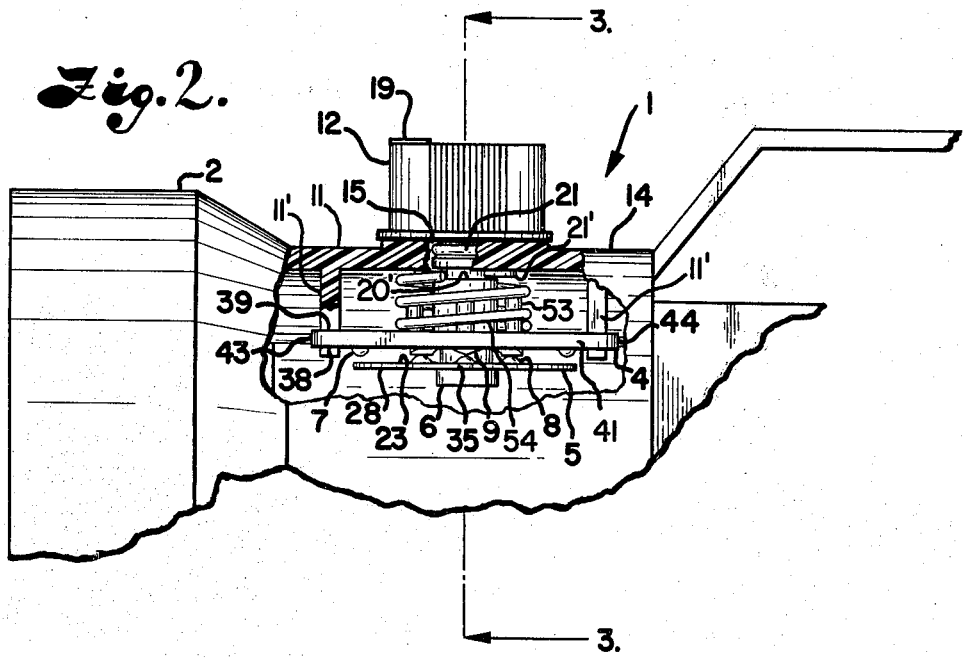
FIG. 2 is an enlarged side elevational view of the rotary switch.

The rotary switch 1 may be supported by any suitable member positioned between the stator 4 and the operating knob 12 on the stem 3. The support 11 for the rotary switch 1 may be a portion of a housing 14 of the lantern 2 which has an aperture 15 therethrough for receiving the stem 3. The aperture 15 is adapted to permit rotation of the stem 3 through full circle. The support 11 may have a suitable abutment engageable by the stator 4 and thereby prevent rotation or turning thereof, such as ribs or the like, as best seen in FIG. 2. The abutment of the support 11 prevents turning of the stator 4 relative to the support 11 and relative to the stem 3.

The stem 3 is an elongated member rotatably extending through the aperture 15 in the housing 14 and the stem 3 is operative to effect selected movement of the switch rotor 5 relative to the stator 4 and the contact heads 7 thereon. In the illustrated structure, the stem 3 is an elongated generally cylindrical member having the operating knob 12 on the end opposite the switch rotor 5. The operating knob 12 may be integral with the stem 3 or may be suitably secured thereon, as by screws, rivets, adhesive, or the like. The operating knob 12 may be any desired shape, such as in the form of a pointer or round and having a pointer 19 thereon which is movable relative to the support 11 to thereby designate the position of the switch rotor 5 and the particular circuit or circuits closed or completed by the switch rotor 5.

The rotary switch 1 is particularly adapted for use in waterproof articles, such as a waterproof lantern, therefore, the stem 3 has a suitable annular recess or groove 20 in the exterior surface thereof and the recess or groove 20 is adapted to receive a suitable seal member, such as an O-ring 21. The O-ring seal 21 is positioned to sealingly engage surfaces defining the aperture 15 in the housing 14.

A keeper 21' is mounted in a suitable recess or groove 20' in the exterior surface of the stem 3. The keeper 21' is positioned in engagement with the support 11 thereby limiting movement of the knob 12 toward and away from the support 11. The keeper 21' maintains the seal member 21 in the aperture 15. The keeper 21' is placed in the recess or groove 20' after the stem 3 is in place in the aperture 15 of the support 11.

The one end 6 of the stem 3 is adapted to retain the switch rotor 5 in engagement with the stator 4 in response to operation of a resilient member, as later described. In the illustrated structure, the one end 6 of the stem 3 is of reduced size adapted to extend through the switch rotor 5, as later described. The reduction in size of the stem 3 at the one end 6 thereof provides a shoulder 22 engageable by one surface 23 of the switch rotor 5 which faces the stator to limit extent of movement of the rotor 5 on to the stem 4. The one end 6 of the stem 3 is a cam lock and may be any suitable non-round shape, for a purpose later described.

The shape of the one end 6 of the stem 3 is illustrated as being generally triangular with one apex removed to provide opposed flat sides 24 and 25. The one end 6 of the stem 3 has a plurality of ears 26 extending laterally outwardly from the stem 3 with each having a surface 27 in facing relation with the shoulder 22. The surfaces 27 of the ears 26 are thereby adapted to engage the other surface 28 of the switch rotor 5. The stem 3 has a plurality of flat surfaces 29 positioned adjacent the ears 26 respectively, for a purpose later described. The flat surfaces 29 are each positioned between a respective one of the ears 26 and the shoulder 22. The flat surfaces 29 have length longitudinally of the stem that is preferably greater than the thickness of the rotor 5 and the stem portion 30 between the flat surfaces 29 and the shoulder 22 is cylindrical and of reduced size so the rotor may rotate thereabout.

The switch rotor 5 is an electrically conductive member removably mounted on the stem 3 and positioned in engagement with retainer means on the one end 6 of the stem 3, as defined by the ears 26, and the switch rotor 5 has the one surface 23 thereof in facing relation with the stator 4. The switch rotor 5 is rotatable with the stem 3 and is adapted for engagement with selected electrical contact heads 7. In the illustrated structure, the switch rotor 5 is a generally circular member having an aperture therethrough for receiving the stem 3.

The aperture through the switch rotor 5 has a non-circular shape substantially corresponding to the non-circular shape of the one end 6 of the stem 3. The illustrated aperture is defined by a plurality of connected straight edges each positioned in an angular relation with adjacent edges and may be any desired non-round shape, such as square, rectangular, or the like. In the illustrated structure, the aperture through the switch rotor 5 is generally triangular in shape and is defined by connected straight edges 31, 32, and 33 with the edges positioned in an angular relation with adjacent edges to define an equilateral triangle. The defined triangle may have rounded portions at the intersection of the straight edges.

The straight edges 31, 32 and 33 define an aperture through the switch rotor 5 which is slightly larger than the one end 6 of the stem 3 which has one less ear extending therefrom than the number of straight edges of the aperture through the switch rotor 5 whereby the stem 3 may be removed from the switch rotor 5 after aligning the one end 6 of the stem 3 with the aperture through the switch rotor 5. After the one end 6 of the stem 3 is extended through the switch rotor 5 to position the rotor at the stem portion 30, the stem 3 is rotated relative to the switch rotor 5 to position the surfaces 27 of the ears 26 in overlying relation with the other surface 28 of the switch rotor 5 and to position the flat surfaces in registry with respective straight edges of the aperture through the switch rotor 5. The rotor 5 is then moved to engage the surfaces 27 of the ears 26 with the surface 28 and the flat surfaces 29 in keying engagement with respective straight edges 31 and 32 of the aperture in the rotor. The switch rotor 5 and the stem 3 are locked or keyed together by operation of mutually engaging edges and surfaces and in response to action of a resilient member, as later described. In the illustrated embodiment, a portion of the flat side 24, of the one end 6 of the stem 3 is engageable with the other straight edge 33 of the aperture through the switch rotor 5 whereby turning the stem 3 effects turning or rotation of the switch rotor 5 relative to the stator 4.

In the illustrated structure the cam followers 8 are on the rotor 5. The one surface 23 of the switch rotor 5 has a plurality of the cam followers 8 extending therefrom and movable along the cam surface 9 to control engagement of the rotor 5 with selected contact heads 7 in response to rotation of the stem 3. The cam followers 8 are preferably three or more and inwardly relative to the contact heads. The cam followers 8 are illustrated as being formed by dimples or bumps in the other surface 28 which form bosses in the one surface 23 and in the illustrated structure, there are four bosses or cam followers 8 arranged in a circular pattern and on (90°) centers.

The switch rotor 5 may be any desired shape and preferably is flat whereby the surface 23 may be in engagement with any number of contact heads 7. The switch rotor 5 shown in FIG. 4 is circular and has a plurality of circumferentially spaced contact head receiving portions positioned adjacent a peripheral edge thereof. In the illustrated structure, the head receiving portions are defined by notches 34, 35, and 36 in the peripheral edge of the switch rotor 5. The notches 34 and 36 are positioned in opposed relation with the notch 35 being positioned between and at a (90°) spacing from each of the notches 34 and 36.

The switch rotor 5 has a cut-out 37 in the peripheral edge thereof with the cut-out 37 being positioned and sized so that there is one less head receiving portion or notch than the number of electrical contact heads 7 whereby a selected one of the electrical contact heads 7 is out of contact with the switch rotor 5 when the remaining electrical contact heads 7 are in contact with the switch rotor 5. In the illustrated structure, the cut-out 37 is positioned in opposed relation with the notch 35 and between the notches 34 and 36 and at a (90°) spacing from each of the notches 34 and 36.

The stator 4 is a dielectric member having opposite surfaces 38 and 39, with the surface 38 being in facing relation with the one surface 23 of the switch rotor 5 and the other surface 39 being in facing relation with the support 11. The stator 4 has an aperture 40 therethrough for receiving the stem 3 and the aperture 40 is adapted to permit rotation of the stem 3 through a full circle.

There may be any number of contact heads 7, particularly when the switch rotor 5 is flat and does not have notches or contact head receiving portions. The number of contact heads 7 is determined by the electrical circuits to be completed by the switch 1. In the illustrated embodiment, there are four of the electrical contact heads 7 which are positioned in circumferentially spaced relation and are arranged in a circular pattern and on (90°) centers. The contact heads 7 extend from the surface 38 of the stator 4 thereby positioning same to be engageable by the switch rotor 5 when the four cam followers 8 are in respective valleys in the cam surface 9, as later described.

The stator 4 may be any suitable shape, such as square or rectangular, having side edges 41 and 42 and end edges 43 and 44. In the illustrated structure, the other surface 39 of the stator 4 has a pair of spaced recesses extending inwardly from the end edge 43 and a pair of spaced recesses extending inwardly from the end edge 44 of the stator 4. The four electrical contact heads 7 are defined by round head rivets or the like. extending from the surface 38 of the stator 4. The electrical contact means includes suitable conductor gripping portions 49 connected to the rivets or the like. Each of the conductor gripping portions 49 are positioned in a respective one of the recesses as desired.

The cam surface 9 provides means on the surface 38 of the stator 4 engageable by the cam followers 8 on the switch rotor 5 to direct movement of the switch rotor 5 into and out of enagement with the electrical contact heads 7. The illustrated cam surface 9 on the stator 4 has a plurality of alternating crests 50 and valleys 51. The cam surface 9 is positioned to define an annular ring on the surface 38 of the stator 4 in facing relation with the surface 23 of the switch rotor 5. The cam surface 9 has a plurality of ramps 52 each positioned between a respective crest 50 and the valley 51. In the illustrated structure, there are four valleys 51 and four crests 50 thereby corresponding to the number of cam followers 8 on the switch rotor 5 and the number of contact heads 7 on the stator 4.

The crests 50 are each illustrated as radially extending ridges between adjacent ramps 52 and the valleys 51 are each illustrated as radially extending grooves between adjacent ramps 52 and the valleys 51 are each adapted to receive a respective one of the cam followers 8 therein.

The four electrical contact heads 7 are each engageable by the switch rotor 4 when the cam followers 8 are received in the respective valleys 51 and in the illustrated structure, each of the electrical contact heads 7 is radially aligned with a respective one of the valleys 51 of the cam surface 9. The valleys 51 and ramps 52 are such that as the switch rotor is rotated the cam followers 8 and ramp give a quick movement to the stator separating the switch rotor and the contacts providing a circuit interruption that avoids flickering of the light.

The contact heads 7 are positioned in surrounding relation with the cam surface 9 and each are adapted to be received in a respective one of the notches in the peripheral edge of switch rotor 5. The switch rotor 5 is moved into and out of engagement with the contact heads 7 as the bosses or cam followers 8 move into and out of respective valleys of the cam surface 9. The surface 23 of the switch rotor 5 is generally planar or flat. The surface 23 of the switch rotor 5 is moved out of engagement with the contact heads 7 as the cam followers 8 move over crests of the cam surface 9.

The housing 14 includes means extending from the support 11, as defined by the housing 14 of the lantern 2, for positioning the stator 4 in a selected position relative to the support 11 when the stator 4 is moved toward the support 11 during assembly of the rotary switch 1. In the illustrated structure, the support 11 has spaced guide members 11′ extending inwardly and slidably received in apertures 4′ in the stator whereby the stator has guided movement longitudinally of the stem 3. The stator has a plurality of circumferentially spaced projections or posts 53 extending from the other surface 39 of the stator 4 and terminating in spaced relation to the support 11. A resilient means, such as a compression spring 54, is positioned between the stator 4 and the support 11 for maintaining the stator 4 and switch rotor 5 in engagement and for effecting relative movement between the stator 4 and switch rotor 5 thereby permitting movement of the switch rotor 5 into engagement with selected electrical contact heads 7. In the illustrated structure, the spring 54 is sleeved on the posts or projections 53 and has opposite ends thereof in engagement with the support 11 and the stator 4 to thereby maintain the switch rotor 5 in engagement with the stator 4 by applying force to the stator 4 urging same and the switch rotor 5 toward the one end 6 of the stem 3.

In the structure illustrated the stator 4 floats but the stator and switch rotor 5 are maintained parallel and normal to the axis of the stem 3. This relationship is provided by the arrangement of pressure points between portions of the stem, switch rotor and stator. There is a pressure point provided between the stem and switch rotor and in the illustrated structure it is the engagement of the surfaces 27 of the ears 26 with the other surface 28 of the switch rotor 5. One of the sets of contact heads and cam followers 8 provide cooperative pressure points between the stator 4 and switch rotor 5 and define a triangle or polygon that has the stem axis and the pressure points between the stem and switch rotor within the confines thereof. In the structure illustrated the cam followers 8 and the engagement thereof with the cam surface 9 provide the pressure points between the stator and switch rotor. With the four cam followers of the rotor shown in FIG. 4, or the three cam followers 8 of the rotor shown in FIG. 11, a polygon with the cam followers as corners is positioned with the pressure points between the stem and switch rotor located therein. With this structure the force of the spring 54 acts through said pressure points so the stator 4 and switch rotor 5 are parallel in all positions as the rotor 5 is rotated and positively holds the contact positions avoiding any flickering of a light controlled thereby.

In assembly of a rotary switch constructed as illustrated and described, the stem 3 is extended through the aperture 15 in the support and the knob 12 is positioned in engagement with the housing 14 or support 11. The keeper 21′ is then mounted in the groove 20′ in the stem 3 to retain the stem 3 in position with the knob 12 in engagement with the exterior surface of the support 11. The spring 54 is sleeved on the stem 3 and coaxially aligned therewith. The stator 4 is then positioned with aperture 40 around the stem 3 and the posts or projections 53 received in the spring 54. The switch rotor 5 is positioned adjacent the stator 4 and with the aperture in the switch rotor 5 aligned with the one end 6 of the stem 3 and then moved toward the shoulder 22 on the stem 3. The switch rotor 5 or the stem 3 is then turned relative to the other to position the ears 26 with the surfaces 27 thereof in engagement with the other surface 28 of the switch rotor 5, inside of a polygon defined by the cam followers 8 and with the flat surfaces 29 on the stem 3 in engagement with respective straight edges of the aperture through the switch rotor 5 thereby completing the assembly of the rotary switch.

In using a rotary switch constructed as illustrated and described, the operating knob 12 is turned to move the cam followers 8 along the cam surface 9 and thereby move the switch rotor 5 into engagement with selected electrical contact heads 7 completing the desired electrical circuit or circuits. The operating knob 12 may be moved to any one of four switch positions as desired. The circuits completed by switch rotor 5 are determined by which the conductor gripping portions 49 have an electrical conductor secured therein and which one of the electrical contact heads 7 is not engaged by the switch rotor 5 as determined by the cut-out 37 in the peripheral edge thereof.

FIG. 10 illustrates a modified rotary switch which is substantially similar to the rotary switch shown in FIGS. 1 to 9 inclusive except that a stem 3' has an integral pointer 12' on the exposed end thereof. The pointer 12' tapers from one edge thereof to a point at the other edge thereof with the point designating the position of the switch rotor 5 and the particular circuit or circuits closed or completed by the switch rotor 5. The point of the pointer 12' serves the same purpose as the pointer 19 on the operating knob 12 illustrated in FIGS. 1 to 4 inclusive.

FIG. 11 shows a rotor 55 with three cam followers or bumps 8 and two contact engaging portions 34 to illustrate a variation in the arrangement but with the pressure points around the axis of rotation of the rotor wherein one of the sets of followers or contact portions define a polygon that has the pressure points of the ears 26 on the switch rotor therein so that the rotor is maintained in a plane normal to the axis of the rotation or of the stem.

It is to be understood that while I have illustrated and described one form of my invention, it is not to be limited to the specific form or arrangement of parts herein described and shown.

What we claim and desire to secure by Letters Patent is:

1. A rotary switch comprising:

a. an elongated rotatable stem having an operating knob on one end thereof and retainer means on the other end thereof and keying surfaces adjacent said retainer means;

b. a stator having an aperture therethrough for rotatably receiving said stem;

c. spaced electrical contact means on said stator including a plurality of spaced heads extending therefrom;

d. an electrically conductive switch rotor positioned between said retainer means and said stator, said switch rotor being mounted on said stem and movable longitudinally thereof and having an aperture with keying surfaces in engagement with said keying surfaces of said stem and rotatable therewith, said switch rotor being adapted for selective engagement with said electrical contact means;

e. means on said stator engageable by said switch rotor to permit same to move into and out of engagement with said electrical contact means in response to rotation of said stem;

f. a support positioned between said stator and the operating knob on said stem, said support having an aperture therethrough for receiving said stem and permit rotation of said stem;

g. means between said stator and said support for retaining said stator against rotation and permitting movement of the stator longitudinally of said stem; and h. resilient means between the support and stator urging the stator toward the switch rotor for maintaining engagement thereof and the switch rotor in engagement with the retainer means with the keying surfaces engaged and permitting the switch rotor to engage selected electrical contact means in response to rotation of said stem.

2. A rotary switch as set forth in claim 1 wherein:

a. said switch rotor has a plurality of spaced head receiving portions positioned adjacent a peripheral edge thereof; and b. said switch rotor has a cut-out in the peripheral edge thereof and positioned and sized so that there is one less head receiving portion than the number of electrical contact heads whereby a selected one of said electrical contact heads is out of contact with said switch rotor when the remaining electrical contact heads are in contact with said switch rotor.

3. A rotary switch as set forth in claim 2 and including:

a. a cam surface on said stator facing the switch rotor and having a plurality of alternating crests and valleys; and b. a plurality of cam followers on said switch rotor and extending therefrom and positioned to be in engagement with said cam surface on said stator whereby said switch rotor is in engagement with selected heads of said electrical contact means when said cam followers are received in the respective valleys of said cam surface.

4. A rotary switch as set forth in Claim 2 wherein:

a. said cam surface on said stator is positioned to define an annular ring on the surface facing said switch rotor;

b. said electrical contact heads are circumferentially spaced and arranged in a circular pattern; and c. each of said electrical contact heads is radially aligned with a respective one of said valleys of said cam surface.

5. A rotary switch as set forth in claim 1 wherein:

a. the aperture through said switch rotor is defined by edges arranged in a non-circular pattern with portions of said edges being keying surfaces;

b. said retainer means on the other end of said stem has a non-circular shape corresponding to the shape of the aperture through said switch rotor whereby said switch rotor may be moved over said retainer means upon relative rotation between said stem and said switch rotor to align the retainer means and aperture;

c. said stem has a circular portion of reduced size and the keying surfaces of the stem are between said reduced sized portion and the retaining means and said switch rotor is rotatable about the stem when the aperture of the rotor is at the reduced sized portion of the stem; and d. said keying surfaces on the stem are a multiple of the keying edges of the rotor aperture providing portions of said retainer means extending laterally outwardly from said stem keying portions and engageable with said switch rotor to retain same on said stem when the keying surfaces of the stem and rotor are engaged.

6. A rotary switch as set forth in claim 5 wherein:

a. said aperture through said switch rotor is defined by a plurality of connected straight edges each positioned in an angular relation with adjacent edges;

b. the laterally outwardly extending portions on said retainer means comprises a plurality of ears; and c. said stem has one less ear extending therefrom than the number of edges of said aperture through said switch rotor whereby said stem may be removed from said switch rotor upon relative rotation between said stem and said switch rotor.

7. A rotary switch comprising:

a. a support having a wall with an aperture therein;

b. an elongate stem extending through said aperture and rotatably mounted therein, said stem having first and second ends of opposite sides of said support wall, said stem having outwardly extending portions at said second end having surfaces facing said support, said stem having a reduced portion spaced from said outwardly extending portions and forming a shoulder facing same, said stem having a non-circular portion having keying surfaces between said reduced portion and the outwardly extending portions;

c. a control member on the stem at said first end and operative to rotate same;

d. a stator having an aperture through which said second end of the stem extends permitting rotation of the stem therein; said stator beng movable longitudinally of said stem; said stator having a plurality of electrical contacts in a coaxial circle radially spaced from the stem;

e. a rotor removably mounted on said second end of the stem and having electrical conductive portions engageable with contacts on the stator in response to rotation of the rotor and movement of the stator toward said rotor, said rotor having an axial opening shaped to move over said second end of the stem and outwardly extending portions in one position and having engagement with said outward extending portions in another position to provide pressure points therebetween, said axial opening having edges positioned to engage said keying surfaces of the stem when said rotor engages the surfaces of the outwardly extending portions of the stem for rotation of the rotor by said stem;

f. resilient means engaging the stator and applying force thereto to move the stator toward the rotor and the rotor toward said outwardly extending portions into keyed engagement of the rotor and stem; and g. cam members and cam followers on the stator and rotor and coopeating to selectively move the stator to separate the stator and rotor and to permit movement of the stator toward the rotor for engagement of the stator contacts and conductive portions of the rotor, the engagement of one of said plurality of electrical contacts and the rotor and the cam members and followers providing at least three spaced pressure points between the stator and rotor that define a polygon within which the stem axis and the pressure points between said outwardly extending portions and rotor are located.

8. A rotary switch as set forth in claim 7 wherein:

a. the pressure points between the rotor and stator are the plurality of electrical contacts engagement with the rotor conductive portions with the plurality of electrical contacts being at least three and defining said polygon;

b. the outwardly extending portions at the second end of the stem are spaced ears.

9. A rotary switch comprising:

a. a support having a wall with an aperture therein;

b. an elongate stem extending through said aperture and rotatably mounted therein, said stem having first and second ends on opposite sides of said support wall, said stem having outwardly extending portions at said second end having surfaces facing said support, said stem having a reduced portion spaced from said outwardly extending portions and forming a shoulder facing same, said stem having a non-circular portion having keying surfaces between said reduced portion and the outwardly extending portions;

c. a control member on the stem at said first end and operative to rotate same;

d. a stator having an aperture through which said second end of the stem extends permitting rotation of the stem therein; said stator being movable longitudinally of said stem; said stator having electrical contact means including a plurality of electrical contact heads extending therefrom toward said second end of the stem in a coaxial circle spaced from the stem;

e. a rotor removably mounted on said second end of the stem and having electrical conductive portions engageable with contacts on the stator in response to rotation of the rotor and movement of the stator toward said rotor, said rotor having an axial opening shaped to move over said second end of the stem and outwardly extending portions in one position and having engagement with said outward extending portions in another position to provide pressure points therebetween, said axial opening having edges positioned to engage said keying surfaces of the stem when said rotor engages the surfaces of the outwardly extending portions of the stem for rotation of the rotor by said stem;

f. resilient means engaging the stator and applying force thereto to move the stator toward the rotor and the rotor toward said outwardly extending portions into keyed engagement of the rotor stem;

g. cooperative means on the stator and rotor effecting movement of the stator to separate the contact heads and conductive portions of the rotor in response to selective rotation of the rotor;

h. the engagement of the contact heads and rotor provide at least three spaced pressure points that define a polygon within which the stem axis and the pressure points between said outwardly extending portions and rotor are located.

10. A rotary switch as set forth in claim 9 wherein:

a. said rotor has a plurality of spaced head receiving portions positioned adjacent a peripheral edge thereof, said head receiving portions comprising notches in the peripheral edge of said rotor;

b. said rotor has a cut-out in the peripheral edge thereof and positioned and sized so that there is one less head receiving portion than the number of electrical contact heads whereby a selected one of said electrical contact heads is out of contact with said switch rotor when the remaining electrical contact heads are in contact with said rotor;

c. said stator has a plurality of circumferentially spaced projections extending therefrom toward said support and terminating in spaced relation thereto permitting movement of the stator longitudinally of the stem; and d. said resilient means engaging the other surface of said stator and said support comprises a coil spring sleeved on said plurality of projections and adapted to urge said stator and said rotor toward said outwardly extending portions on said stem.

11. A rotary switch as set forth in claim 9 wherein:

a. the aperture through said rotor is generally triangular in shape and defined by a plurality of connected straight edges each positioned in an angular relation with adjacent edges;

b. the keying surfaces of said stem are a plurality of flat surfaces each engageable with a respective one of said straight edges defining the aperture through said rotor;

c. said outwardly extending portions comprise a plurality of ears extending laterally outwardly from said stem, said ears each being aligned with a respective one of the flat surfaces on said stem; and d. said stem has one less ear extending therefrom than the number of edges of said aperture through said rotor whereby said stem may be removed from said rotor upon rotation of said stem relative to said rotor.

* * * * *